US005366759A

United States Patent [19]

Beckerle et al.

[11] Patent Number: 5,366,759

[45] Date of Patent: * Nov. 22, 1994

[54] METHOD OF LACQUERING THE LUMINOPHORE LAYER OF A COLOUR PICTURE TUBE

[75] Inventors: Heinz Beckerle; Rolf Reidinger, both of Ebersbach, Germany

[73] Assignee: Nokia (Deutschland) GmbH, Pforzheim, Germany

[ * ] Notice: The portion of the term of this patent subsequent to Aug. 2, 2011 has been disclaimed.

[21] Appl. No.: 907,328

[22] Filed: Jul. 1, 1992

Related U.S. Application Data

[63] Continuation-in-part of Ser. No. 788,171, Nov. 5, 1991.

[30] Foreign Application Priority Data

Nov. 14, 1990 [DE] Germany ..... 4036239

[51] Int. Cl.[5] ..... B05D 5/06

[52] U.S. Cl. ..... 427/64; 427/240; 427/379; 427/407.2; 427/419.1; 427/419.2; 427/419.3

[58] Field of Search ..... 427/64, 68, 379, 407.2, 427/419.1, 419.2, 419.3, 240, 421

[56] References Cited

U.S. PATENT DOCUMENTS

| | | | |
|---|---|---|---|
| 3,652,323 | 3/1972 | Smith | 427/68 |
| 4,139,657 | 2/1979 | Watanabe | 427/68 |
| 4,196,015 | 4/1980 | Lopez | 427/68 |
| 4,542,038 | 9/1985 | Odaka et al. | 427/68 |

FOREIGN PATENT DOCUMENTS

| | | |
|---|---|---|
| 2329741 | 9/1975 | Germany . |
| 2450834 | 4/1976 | Germany . |

*Primary Examiner*—Janyce Bell

*Attorney, Agent, or Firm*—Ware, Fressola, Van Der Sluys & Adolphson

[57] ABSTRACT

The following steps are performed in a method of lacquering the luminophore layer of a color picture tube:

the luminophore layer is first prewetted, a first aqueous dispersion of a lacquer is applied to the prewetted luminophore layer, this first dispersion is fully dried and heated to above the film formation temperature of the lacquer, thereby producing a first lacquer film, a second aqueous dispersion is applied directly to the first lacquer film, where the said second aqueous dispersion has exactly the same components as the first dispersion and the concentration of the components in the second dispersion corresponds at least to a large extent to the concentration of these components in the first dispersion, and this second dispersion is fully dried and heated to above the film formation temperature of the lacquer, thereby producing a second lacquer film. This two-stage lacquering process makes it possible obtain screen brightnesses that are about 10% greater than can be obtained by means of conventional single-stage lacquering methods.

8 Claims, 1 Drawing Sheet

METHOD OF LACQUERING THE LUMINOPHORE LAYER OF A COLOUR PICTURE TUBE

This is a continuation-in-part of copending application Ser. No. 07/788,171 filed on Nov. 5, 1991.

BACKGROUND OF THE INVENTION

1. Technical Field

The present invention relates to a method of lacquering the luminophore layer on the screen trough of a colour picture tube.

2. State of the Art

When lacquering the luminophore layer on the screen trough of a colour picture tube, it is customary to make use of an aqueous dispersion of a lacquer. Examples of suitable lacquers are given, among others, in U.S. Pat. No. 3,317,337 and DE-A-30 46 373 (U.S. Pat. No. 4,409,352). In practice there are essentially two methods for applying the dispersion. One of these, described—for example—in U.S. Pat. No. 3,317,337, consists of arranging the screen trough so that its luminophore surface points upwards, filling dispersion into it, and then causing it to revolve at a high speed so as to distribute the dispersion, eventually tipping the trough sideways to permit excess dispersion to drain off. A second known application method consists of spraying the dispersion upwards and against the screen, which for this purpose is set either vertically or pointing obliquely downwards. Following the spraying, the screen trough is set to rotate at speed so as to distribute the dispersion evenly over the luminophore layer and, at one and the same time, to throw off the excess dispersion.

With a view to making possible good wetting of the luminophore layer by the dispersion, it is common practice to precede the application of the dispersion to the luminophore by a prewetting step. Materials and methods suitable for this purpose are described, for example, in EP-B-149 838. Following the even distribution of the dispersion over the luminophore layer, the dispersion is fully dried and then heated to above the film formation temperature of the lacquer in order to produce a lacquer film. Subsequently—although this no longer forms part of the method of lacquering the luminophore layer—vaporized aluminium is deposited on the lacquer, so that the latter volatilizes and only an aluminium film is left as a reflection layer behind the luminophore layer.

Conventional methods of lacquering the luminophore layer on the screen trough of a colour picture tube therefore comprise the following steps:

the luminophore layer is prewetted, an aqueous lacquer dispersion is distributed evenly over the luminophore layer, and the dispersion is fully dried and heated to above the film formation temperature of the lacquer, thereby producing a lacquer film.

Apart from these traditional methods with a single lacquering step, methods involving two lacquering steps are also known in literature. The previously mentioned U.S. Pat. No. 3,317,337, for example, describes a method according to which a 6% dispersion of a polyvinyl acetate in water is first applied to the luminophore layer. This first dispersion is then fully dried and heated to above the film formation temperature of the lacquer in order to produce a first lacquer film. The next step consists of applying a 10% dispersion of an acrylic resin in water, again followed by drying and heating to above the film formation temperature. Neither of the two lacquering steps is preceded by prewetting. Both layers are applied by spraying a puddle into the centre of the screen trough, which is then made to rotate.

An identical procedure, though using different aqueous dispersions, is described in DE-A-27 10 308. According to the examples given in the specification, the first dispersion contains either about 3% or about 6% of a copolymer of n-butyl acrylate and metacrylic acid, while the second dispersion contains about 15% of an acrylic resin.

Procedures using two layers of lacquer have not proved successful in practice largely in view of the fact that the first lacquer film was often damaged in the process of applying the second dispersion. No clear advantage ensued which could offset this drawback.

Notwithstanding the many known lacquering methods, all different from each other, there still remained the problem of so configuring a method of this type as to obtain better lacquering results , which ultimately means greater screen brightness.

SUMMARY OF THE INVENTION

The method of lacquering the luminophore layer on the screen trough of a colour picture tube according to the present invention has the following characteristics:

the luminophore layer is first prewetted, a first aqueous dispersion is then applied to the prewetted luminophore layer, this first dispersion is fully dried and heated to above the film formation temperature of the lacquer, thereby producing a first lacquer film, a second aqueous dispersion is applied directly onto the first, the said second aqueous dispersion having exactly the same components as the first, where the concentration of the components in the second dispersion corresponds at least to a large extent to the concentration of the components in the first dispersion, and the second dispersion is fully dried and heated to above the film formation temperature of the lacquer, thereby producing a second lacquer film.

It has been found that if the first lacquering is preceded by prewetting, though not the second, lacquering results are obtained that lead to an extraordinary increase in the brightness hitherto obtained. Whereas conventional further developments of lacquering technique in such matters as material selection and procedure brought only very small improvements in screen brightness, the method according to the present invention produces a brightness increase of the order of 10%. This brightness increase was confirmed by several test series, i.e. the lacquering method functions in a reliable manner. In other words, the application of the second dispersion no longer deforms the first film to such an extent as to produce a loss of brightness in many tubes. The situation seems to be that the prewetting causes the first lacquer film to adhere so well that the application of the second dispersion does not attack it to any appreciable extent. In this connection it is important that the application of the second dispersion should not be preceded by prewetting. It has been found that if the application of the second dispersion is preceded by prewetting, the first lacquer layer will often suffer appreciable changes with negative effects on the overall lacquering result.

The more quickly the application of the second dispersion to the first lacquer film is followed by drying, the better the lacquering results, i.e. the greater will be the gain in brightness. In this connection it is advantageous to apply the second dispersion by means of the per se known method of spraying from below against the rotating luminophore layer while it is either in a vertical position or points obliquely downwards and then setting the screen trough to rotate at a high speed in order to distribute the dispersion in a thin layer over the first film and throw off any excess dispersion. If another method is used, a case in point being the method of spraying a dispersion puddle into the centre of the screen trough and throwing off the excess by rotation, the resulting covering is unevenly distributed over the surface of the screen and the worst picture brightness is obtained where the dispersion remained in contact for the longest period of time, i.e. in the centre of the screen when using a method in which the dispersion is applied in the form of a puddle at the centre.

For technical reasons, it will be particularly advantageous to produce both lacquer films with the same dispersion. But slightly better lacquering results will be obtained when the concentration of the components in the second dispersion is slightly greater than their concentration in the first. The concentration of the components in the second dispersion should therefore correspond at least to a large extent to the component concentration in the first dispersion.

BRIEF DESCRIPTION OF THE DRAWINGS

The invention will now be discussed in greater detail by reference to figures and illustrated embodiments. The appended drawings are as follows.

DESCRIPTION OF THE PREFERRED EMBODIMENT

Tests were carried out with dispersions of different lacquer-forming materials—especially acetates and acrylates—in aqueous solution. Particularly good results were obtained with a dispersion prepared in accordance with the example of DE-A-30 46 373 (U.S. Pat. No. 4,409,352). The example there given concerns a dispersion with about 17% of solids. The concentration of this dispersion was reduced to about half by the addition of demineralized water.

Figure 1:
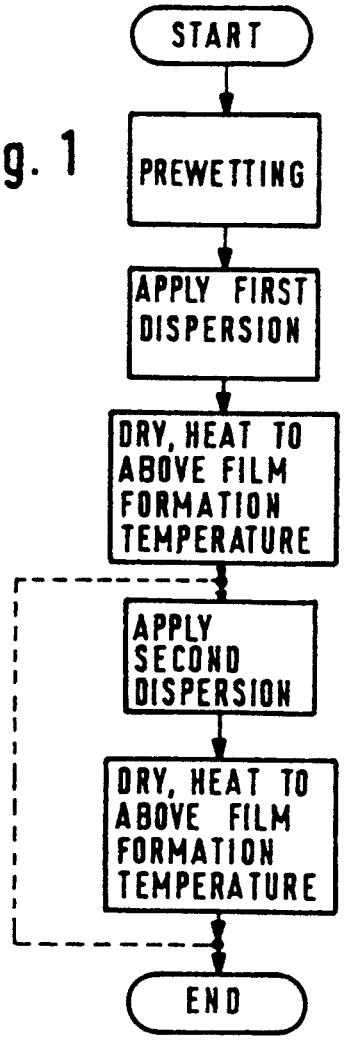
FIG. 1 shows a flow diagram illustrating a method of lacquering the luminophore layer of a colour picture tube with two layers of lacquer.
Figure 2:
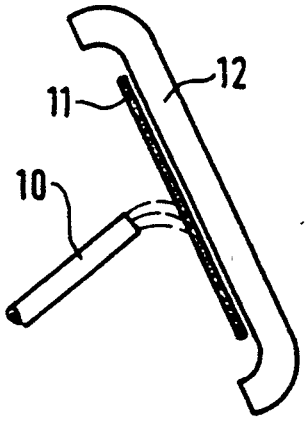
FIG. 2 shows a schematic view of a screen trough with luminophore layer while a lacquer dispersion is being sprayed onto it.

Following the application of a luminophore layer to the screen trough, the first step of the lacquering method, as shown in FIG. 1, consisted of prewetting the said luminophore layer. This was done as described in EP-B-149 838. The lacquer dispersion produced as per DE-A-30 46 373, i.e. a dispersion of 8.5% by weight of polyacrylate in aqueous solution, was then applied. As schematically shown in FIG. 2, the application took the form of spraying the dispersion through a nozzle 10 onto the luminophore layer 11 on a screen trough 12 pointing obliquely downwards. The screen trough was slowly rotated during the spraying process. The speed of revolution was then increased to distribute the sprayed-on dispersion as a fine film over the entire luminophore layer and to eliminate the excess dispersion.

This was followed by drying and heating to above the film formation temperature at just over 40 degrees Celsius. This drying and heating to above the film formation temperature was obtained by means of infrared radiation within the space of a few minutes. The last two steps, i.e. application and distribution of the dispersion and the subsequent drying and heating to above the film formation temperature, were then repeated. But repetition of steps 2 and 3 is not preceded by the first step, i.e. prewetting.

Figure 3:
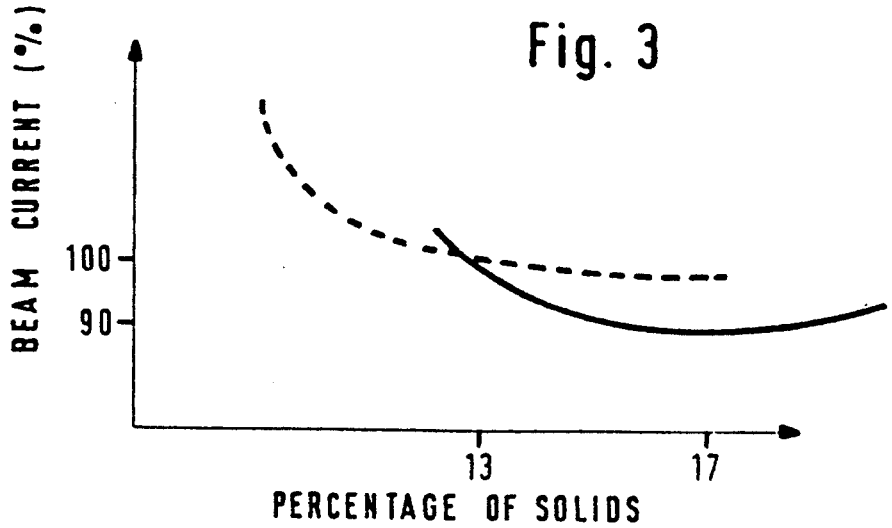
FIG. 3 shows a diagram to illustrate the relationship between the proportion of lacquer in the dispersion and the beam current needed in the colour picture tube to obtain a given brightness.

FIG. 3 illustrates the brightness improvement obtained as compared with the conventional lacquering method of DE-A-30 46 373. The dotted line shows the relationship between the percentage of solids in the dispersion and the beam current needed in a colour picture tube to obtain a given brightness in the case of single-layer lacquering. The proportion of solids was varied between 8 and 18%. As can be seen, the beam current needed to obtain a given brightness hardly changes when the proportion of solids lies between 12 and 18%. Percentagewise, this current is designated as 100%. If the proportion of solids is diminished, a greater beam current will be needed to obtain the given brightness. This is due to the fact that in these cases the aluminium layer applied on the lacquer layer will be disturbed by the penetrant luminophore layer. If the proportion of solids is increased above 18%, the aluminium film will again suffer disturbance, though this time not on account of penetration of the luminophore layer, but rather because bubbles will be formed as the lacquer film evaporates through the aluminium layer.

The full line in FIG. 3 illustrates the corresponding relationship in the case of the method set out in FIGS. 1 and 2. In this case the proportion of solids is the sum of the percentages of solids in the two dispersions. Since in the embodiment here considered both dispersions contain 8.5% of solids, the total for the purposes of FIG. 3 is 17%. It can be seen that considerable smaller beam currents are needed to obtain the given brightness when this total lies between about 16 and 20%, namely only about 90% of the previous optimal value here designated as 100%. With a given beam current in actual operation, therefore, the obtainable brightness will be about 10% greater than what could previously be obtained.

It was found that for any given total proportion of solids, the lacquering result will be slightly improved if the concentration of the components in the second dispersion is slightly higher than the concentration of the components in the first dispersion. However, the improvement hardly makes itself felt in the brightness, but rather in the optical impression of the edge area of the screen trough when the tube is not in operation. When dispersions of different concentration are used, the concentration of the first dispersion should not be excessively low. Thus, the proportion of solid lacquer particles in the first solution should not be less than 2%. Good results were obtained with 6.5% polyacrylate in the first dispersion and 9.5% polyacrylate in the second dispersion. These dispersions were once again produced as described in DE-A-30 46 373, increasing only the percentage of demineralized water. To this end the second dispersion was produced as the mother stock, from which the first dispersion was then obtained by further dilution.

It was found that while it was preferable for the second dispersion to be slightly more concentrated than the first dispersion, a range of dispersion concentrations provided improved results over the prior art. In general, the concentration of the second dispersion should not be less than 80 percent of the concentration of the first dispersion. For example, the concentration of the first dispersion may be ten percent, while the concentration of the second dispersion may be 8.5 percent. Such ratios were found to provide excellent results over those of the prior art.

Attention should here be drawn to the fact that further lacquer films can be applied in analogy with the second lacquer layer, i.e. by applying a lacquer dispersion without prior wetting and then drying and heating to above the film formation temperature. The total of the percentages of solids in all the layers must then lie within the optimal range illustrated by FIG. 3. It has however been found that this procedure will not produce a sufficient brightness increase to justify its extra cost.

The possible repetition of the last two steps described in FIG. 1 is there indicated by a dotted line that leads from the end of the last step back to the beginning of the penultimate step.

What is claimed is:

1. A method of lacquering the luminophore layer on the screen trough of a colour picture tube, wherein a first aqueous dispersion of a lacquer is applied to the luminophore layer, the first dispersion is fully dried and heated to above the film formation temperature of the lacquer, thereby producing a first lacquer film, a second aqueous dispersion of a lacquer is applied to the lacquer film, and this second dispersion is fully dried and heated to above the film formation temperature, thereby producing a second lacquer film characterized in that identical components are used for both dispersions and the concentration of the components in the second dispersion is less than the concentration of the components in the first dispersion, and the luminophore layer is prewetted before the first aqueous dispersion is applied, while the second aqueous dispersion is applied directly to the first lacquer film.

2. A method in accordance with claim 1, characterized in that at least the second dispersion is sprayed from below against the rotating luminophore layer, which is either in a vertical position or points obliquely downwards, and on completion of the spraying—the screen trough is set to rotate at a high speed in order to distribute the dispersion over the first film.

3. A method in accordance with claim 1, characterized in that further films of lacquer are applied in the same way as the second.

4. Method in accordance with claim 2, characterized in that further films of lacquer are applied in the same way as the second film.

5. A method in accordance with claim 1, characterized in that the concentration of the components in the second dispersion is nearly equal to the concentration of the components in the first dispersion.

6. A method in accordance with claim 1, characterized in that the concentration of the components in the second dispersion is not less than two percent.

7. A method in accordance with claim 1, characterized in that the concentration of the components in the second dispersion is approximately 6.5 percent, and the concentration of the components in the first dispersion is approximately 9.5 percent.

8. A method in accordance with claim 1, characterized in that the concentration of the components in the first dispersion is approximately 10 percent, and the concentration of the components in the second dispersion is approximately 8.5 percent.

* * * * *